US007124595B2

(12) United States Patent
Park et al.

(10) Patent No.: US 7,124,595 B2
(45) Date of Patent: Oct. 24, 2006

(54) MULTI-TYPE AIR CONDITIONER WITH PLURALITY OF DISTRIBUTOR ABLE TO BE SHUTOFF

(75) Inventors: Jong Han Park, Gwangmyeong-si (KR); Young Min Park, Incheon-si (KR); Chang Seon Lee, Seoul (KR); Sung Oh Choi, Gwangmyeong-si (KR); Sung Chun Kim, Seoul (KR); Seung Yong Chang, Seoul (KR); Seok Ho Yoon, Seoul (KR); Baik Young Chung, Incheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/726,567

(22) Filed: Dec. 4, 2003

(65) Prior Publication Data

US 2004/0139755 A1 Jul. 22, 2004

(30) Foreign Application Priority Data

Jan. 16, 2003 (KR) ..... 10-2003-0003049

(51) Int. Cl.
*F25B 5/00* (2006.01)

(52) U.S. Cl. ..... 62/199; 62/525

(58) Field of Classification Search ..... 62/525, 62/324.6, 504, 524, 199, 224, 324.1, 511, 62/513, 527

See application file for complete search history.

(56) References Cited

U.S. PATENT DOCUMENTS 5,123,255 A * 6/1992 Ohizumi ..... 62/175
5,156,014 A 10/1992 Nakamura et al.
5,647,225 A * 7/1997 Fischer et al. ..... 62/434
5,927,093 A * 7/1999 Noguchi et al. ..... 62/259.1
5,937,665 A * 8/1999 Kiessel et al. ..... 62/260
6,148,631 A * 11/2000 Watanabe et al. ..... 62/296
6,189,335 B1 * 2/2001 Ebara et al. ..... 62/510
6,257,014 B1 * 7/2001 Jao ..... 62/324.6
6,381,974 B1 * 5/2002 Hwang et al. ..... 62/199
2002/0162595 A1 11/2002 Lee et al.
2002/0194857 A1 12/2002 Kato et al.
2003/0113215 A1 6/2003 Chol et al.

FOREIGN PATENT DOCUMENTS

EP 0453271 10/1991

(Continued)

OTHER PUBLICATIONS

English Language Abstract of JP 6-137710.

(Continued)

*Primary Examiner*—Mohammad M. Ali
(74) *Attorney, Agent, or Firm*—Greenblum & Bernstein, P.L.C.

(57) ABSTRACT

Multi-type air conditioner including an outdoor unit installed in an outdoor, including a compressor, a refrigerant flow controlling part connected to a discharge end of the compressor for guiding the refrigerant proper to operation conditions selectively, and an outdoor heat exchanger connected to the refrigerant flow controlling part, a plurality of indoor units each installed in a room and having an indoor heat exchanger and an electronic expansion valve having one end connected to one end of the indoor heat exchanger, a plurality of, at least two, distributors between the outdoor unit and the plurality of indoor units for improving installation freedom of the plurality of indoor units, selectively guiding refrigerant from the outdoor unit to the plurality of indoor units proper to operation conditions, and guiding the refrigerant passed through the indoor units to the outdoor unit again, and a device for shutting off introduction of the refrigerant into the distributors connected to inoperative indoor units.

17 Claims, 7 Drawing Sheets

FOREIGN PATENT DOCUMENTS

| | | | |
|---|---|---|---|
| JP | 6-137710 | | 5/1994 |
| JP | 7-4779 | | 1/1995 |
| JP | EP 0 862 023 | A2 * | 9/1998 |
| JP | 20000304374 | | 11/2000 |
| JP | 20020022306 | | 1/2002 |

OTHER PUBLICATIONS

English Language Abstract of JP 7-4779.
English language Abstract of JP 2002-0022306.
English language Abstract of JP 2000-0304374.

* cited by examiner

MULTI-TYPE AIR CONDITIONER WITH PLURALITY OF DISTRIBUTOR ABLE TO BE SHUTOFF

This application claims the benefit of the Korean Application No. P2003-0003049 filed on Jan. 16, 2003, which is hereby incorporated by reference.

BACKGROUND OF THE INVENTION

1. Field of the Invention

The present invention relates to multi-type air conditioners, and more particularly, to a multi-type air conditioner with a plurality of distributors refrigerant thereto can be shutoff.

2. Background of the Related Art

In general, the air conditioner, an appliance for cooling or heating room spaces, such as living spaces, restaurants, and offices, cools or heats the room space by circulating refrigerant with a compressor and heat exchangers.

The air conditioner succeeds to development of a multi-type air conditioner which can cool or heat rooms at the same time without being influenced from an external temperature or environment for maintaining more comfortable room environments, resulting to cool or heat entire rooms under the same operation mode.

A related art multi-type air conditioner is provided with one or more than one outdoor unit connected to a plurality of indoor units installed in respective rooms, and operative only in one mode of cooling or heating for controlling room temperatures.

However, nowadays, as the room space becomes larger, a room structure becomes complex, and positions and services of rooms are diversified, room environments of the rooms differ from one another. Particularly, a room equipped with machinery or computer has a room temperature higher than other rooms due to heat from operation of the equipment.

Consequently, even though some of the rooms require cooling, while other rooms require heating, the related art multi-type air conditioner can not deal with the requirements.

When the room structure is complex, there are not only a limitation in distribution of the refrigerant to the rooms with only one distributor, but also difficulty in installation.

Moreover, the long pipeline coming from the complex room structure causes pressure drop of the refrigerant introduced into the indoor units, to drop a refrigerating efficiency.

According to above requirements, development of a multi-type air conditioner of concurrent cooling and heating type is required, which is operative in an optimal operation mode pertinent to room environments, i.e., rooms that require cooling are operated in a cooling mode, and rooms that require heating are operated in a heating mode.

Moreover, there are ceaseless requirements for development of a multi-type air conditioner which can secure freedom of installation, and sustain a supercooled state of the refrigerant despite of pressure drop occurred in pipelines connected to the indoor units.

SUMMARY OF THE INVENTION

Accordingly, the present invention is directed to a multi-type air conditioner with a plurality of distributors able to be shutoff that substantially obviates one or more of the problems due to limitations and disadvantages of the related art.

An object of the present invention is to provide an air conditioner which can cool some of rooms, and heats rest of the rooms depending on respective room environments.

Another object of the present invention is to provide a multi-type air conditioner of which freedom of installation is improved, and having a plurality of distributors which can shutoff introduction of refrigerant thereto.

Further object of the present invention is to provide a multi-type air conditioner which can sustain a supercooled state of refrigerant even if a pressure drop of the refrigerant in pipelines connected to indoor units is occurred.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the multi-type air conditioner includes an outdoor unit installed in an outdoor, including a compressor, a refrigerant flow controlling part connected to a discharge end of the compressor for guiding the refrigerant proper to operation conditions selectively, and an outdoor heat exchanger connected to the refrigerant flow controlling part, a plurality of indoor units each installed in a room and having an indoor heat exchanger and an electronic expansion valve having one end connected to one end of the indoor heat exchanger, a plurality of, at least two, distributors between the outdoor unit and the plurality of indoor units for improving installation freedom of the plurality of indoor units, selectively guiding refrigerant from the outdoor unit to the plurality of indoor units proper to operation conditions, and guiding-the refrigerant passed through the indoor units to the outdoor unit again, and a device for shutting off introduction of the refrigerant into the distributors connected to inoperative indoor units.

The refrigerant introduction shutoff device is an ON/OFF valve.

The plurality of distributors include supercooling devices respectively on pipelines high pressure liquid refrigerant flows therein for supercooling the high pressure liquid refrigerant.

The supercooling device includes a leading pipeline branched from a fore end of a pipeline in one of the plurality of distributors the high pressure liquid refrigerant flows therethrough, an expansion means on the leading pipeline for expanding the high pressure liquid refrigerant into low pressure gas refrigerant, first leading branch pipelines having one ends respectively branched from the leading pipeline as many as a number of the plurality of distributors, a heat exchanger part in each of the distributor having one end connected to the other end of the first leading pipeline for sustaining a supercooled state of refrigerant in the high pressure liquid refrigerant connection pipeline, and a second leading branch pipeline for guiding low pressure gas refrigerant passed through the heat exchanger in each of the distributors to the low pressure gas refrigerant connection pipeline to be introduced into the compressor.

The supercooling device further includes a refrigerant shutoff part on each of the first leading branch pipeline.

The outdoor unit further includes a first connection pipeline having one end connected to a discharge end of the compressor and the other end connected to the distributor with the refrigerant flow controlling part and the outdoor heat exchanger connected in succession between the two ends, a second connection pipeline connected to the first connection pipeline connected between the refrigerant flow controlling part and the discharge end of the compressor, for guiding compressed refrigerant to the distributors directly, and a third connection pipeline connected between the suction end of the compressor and the distributors, and has a branch pipeline connected to one end of the refrigerant flow controlling part, for guiding low pressure gas refrigerant to the compressor.

The distributor includes a guide piping system for guiding the refrigerant introduced thereto through the first connection pipeline or the second connection pipeline in the outdoor unit to the indoor units, and the refrigerant from the indoor units to the first connection pipeline or to the third connection pipeline in the outdoor unit proper to operation conditions, and a valve bank on the guide piping system for controlling refrigerant flow such that the refrigerant flows in/out of the indoor units, selectively proper to operation conditions.

The guide piping system includes a high pressure liquid refrigerant connection pipeline having one end connected to the first connection pipeline in the outdoor unit, high pressure liquid refrigerant branch pipelines having one ends branched from the high pressure liquid refrigerant connection pipeline as many as a number of the indoor units and the other ends connected to the other ends of the indoor electronic expansion valves respectively, a high pressure gas refrigerant connection pipeline having one end connected to the second connection pipeline in the outdoor unit directly, high pressure gas refrigerant branch pipelines having one ends branched from the high pressure gas refrigerant connection pipeline as many as the number of the indoor units, and the other ends directly connected to the other ends of the indoor heat exchangers of respective indoor units respectively, a low pressure gas refrigerant connection pipeline having one end connected to the third connection pipeline in the outdoor unit directly, and low pressure gas refrigerant branch pipelines having one ends branched from the low pressure gas refrigerant connection pipeline as many as the number of indoor units, and the other ends connected to the other ends of the indoor heat exchangers of the respective indoor units the high pressure gas refrigerant branch pipelines connected thereto, respectively.

Thus, the present invention can provide a multi-type air conditioner which can operate some of the rooms in a cooling mode and the other rooms in heating mode according to individual room environments, improves an installation freedom of the multi-type air conditioner, and sustaining a supercooled state of the refrigerant.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

For better understanding of the present invention, functions of the multi-type air conditioner of concurrent cooling and heating type will be described at first. The air conditioner serves to control temperature, humidity, air motion, cleanliness of air in a particular area suitable to purpose of use. For an example, the air conditioner serves to cool or heat a residential space or a room space, such as an office, restaurant, and the like.

In such a multi-type air conditioner, in a cooling operation, the room is cooled as low pressure refrigerant having heat absorbed from the room is compressed to a high pressure and discharges heat to an outdoor air, and in a heating operation, a process opposite above process is made.

Since the related art multi-type air conditioner cools or heats all rooms uniformly, the multi-type air conditioner of the present invention suggests differing operation conditions proper to respective room states. Moreover, since the multi-type air conditioner of the present invention is provided with a plurality of distributors, and refrigerant supercooling devices described later, freedom of installation and an air conditioning efficiency can be improved.

Figure 1:
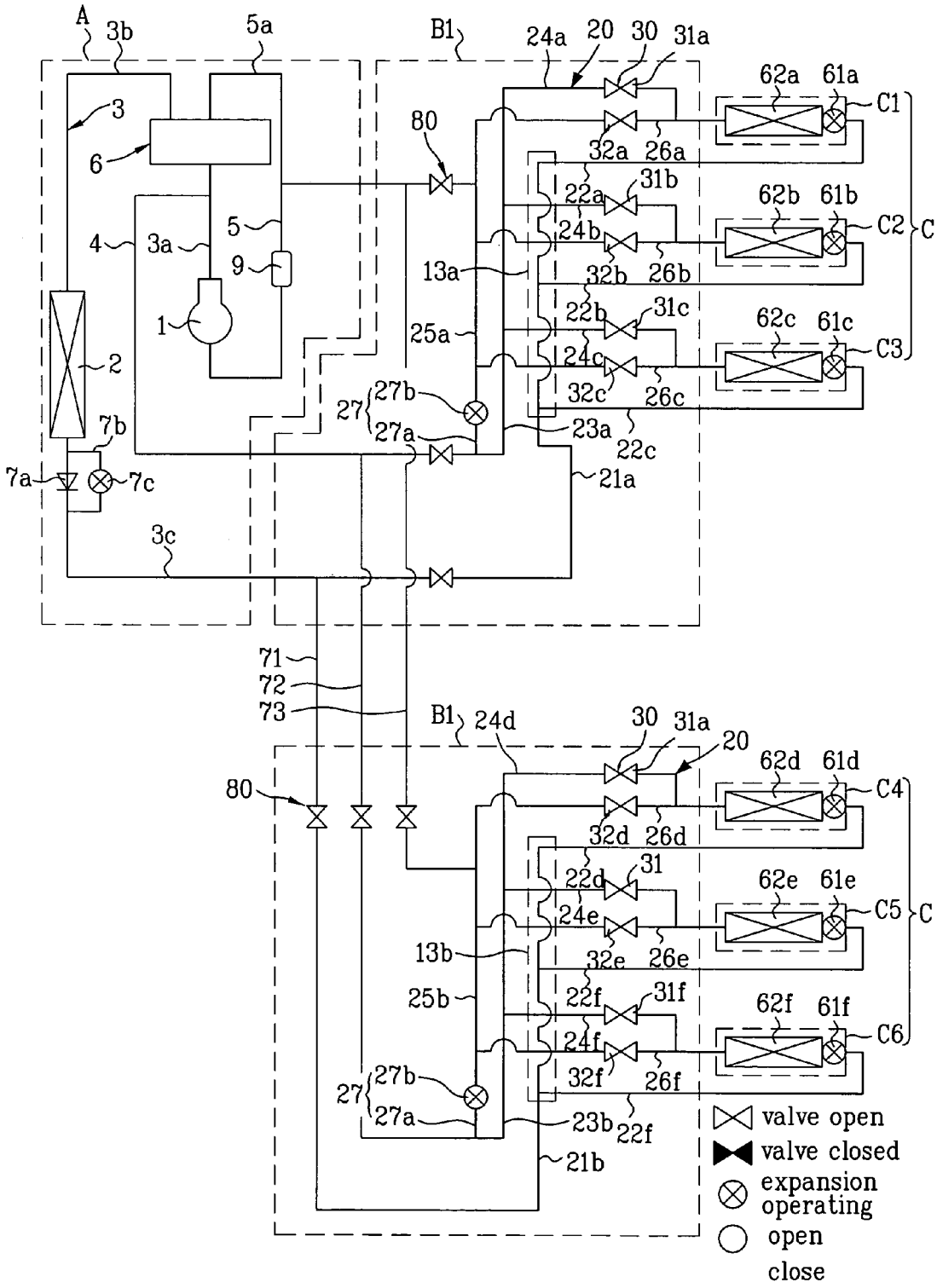
FIG. 1 illustrates a diagram showing a basic system of a multi-type air conditioner with a plurality of distributors introduction of refrigerant thereto can be shutoff, each with a device for supercooling the refrigerant in accordance with the present invention.

A basic system of the multi-type air conditioner with a plurality of distributors and refrigerant supercooling devices is illustrated in FIG. 1.

Referring to FIG. 1, the multi-type air conditioner with a plurality of distributors and refrigerant supercooling devices includes an outdoor unit 'A', a plurality of indoor units 'C', and a plurality of, at least two, distributors 'B' between the outdoor unit and the plurality of indoor units for improving installation freedom of the plurality of indoor units. However, for convenience of description, a number of the indoor units are limited to three, and a number of the distributors are limited to two.

The outdoor unit 'A' includes a compressor 1, a refrigerant flow controlling part 6 connected to a discharge end of the compressor for guiding the refrigerant proper to operation conditions selectively, an outdoor heat exchanger 2 connected to the refrigerant flow controlling part 6.

The outdoor unit further includes a first connection pipeline 3 having one end connected to a discharge end of the compressor 1 and the other end connected to the distributor 'B' with the refrigerant flow controlling part 6 and the outdoor heat exchanger 2 connected in succession, a second connection pipeline 4 connected to the first connection pipeline connected between the refrigerant flow controlling part 6 and the discharge end of the compressor 1, for guiding compressed refrigerant to the distributors directly, and a third connection pipeline 5 connected between the suction end of the compressor 1 and the distributors 'B', and has a branch pipeline 5*a* connected to one end of the refrigerant flow controlling part 6, for guiding low pressure gas refrigerant to the compressor.

The outdoor unit further includes a check valve 7*a* on the first connection pipeline 3*c* between the distributor and the outdoor heat exchanger for passing refrigerant toward the distributor in a cooling mode, and a heating parallel expansion pipe 7*b* having a refrigerant expansion element 7*c* in parallel to the check valve for guiding refrigerant introduced from the distributor through the first connection pipeline to the outdoor heat exchanger 2.

Each of the indoor units 'C' is installed in each of rooms, and has an indoor heat exchanger 62 and an electronic expansion valve having one end connected to one end of the indoor heat exchanger. A reference symbol 3 represents 3*a*, 3*b*, and 3*c*, 'C' represents C1, C2, C3, C4, C5, and C6, 61 represents 61*a*, 61*b*, 61*c*, 61*d*, 61*e*, and 61*f*, and 62 represents 62*a*, 62*b*, 62*c*, 62*d*, 62*e*, and 62*f*.

The plurality of distributors, between the outdoor unit and the indoor units, guides the refrigerant from the outdoor unit 'A' to the plurality of indoor units C1, C2, C3, C4, C5, and C6 selectively proper to respective operation conditions, and guides the refrigerant passed through the indoor units to the outdoor unit, again.

The distributor includes a guide piping system for guiding the refrigerant introduced thereto through the first connection pipeline 3 or the second connection pipeline 4 in the outdoor unit 'A' to the indoor units 'C', and the refrigerant from the indoor units 'C' to the first connection pipeline 3 or to the third connection pipeline 5 in the outdoor unit, and a valve bank 30 on the guide piping system 20 for controlling refrigerant flow such that the refrigerant flows in/out of the indoor units, selectively.

The guide piping system includes a high pressure liquid refrigerant connection pipeline 21 having one end connected to the first connection pipeline in the outdoor unit, high pressure liquid refrigerant branch pipelines 22 having one ends branched from the high pressure liquid refrigerant connection pipeline as many as a number of the indoor units 'C' and the other ends connected to the other ends of the indoor electronic expansion valves 61 respectively, a high pressure gas refrigerant connection pipeline 23 having one end connected to the second connection pipeline in the outdoor unit directly, high pressure gas refrigerant branch pipelines 24 having one ends branched from the high pressure gas refrigerant connection pipeline as many as the number of the indoor units, and the other ends directly connected to the other ends of the indoor heat exchangers 62 respectively, a low pressure gas refrigerant connection pipeline 25 having one end connected to the third connection pipeline 5 in the outdoor unit directly, and a low pressure gas refrigerant branch pipelines 26 having one ends branched from the low pressure gas refrigerant connection pipeline as many as the number of indoor units, and the other ends connected to the other ends of the indoor heat exchangers the high pressure gas refrigerant branch pipelines 24 connected thereto, respectively.

The valve bank 30 includes selection valves 31 and 32 on the high pressure gas refrigerant branch pipelines 24 and the low pressure gas refrigerant branch pipelines 26 for closing the valves 31 on the high pressure gas refrigerant branch pipelines and opening the valves 32 on the low pressure gas refrigerant branch pipelines in a case of room cooling, and opening/closing the valves in an opposite manner in a case of room heating, for controlling refrigerant flow.

It is preferable that the distributor further includes liquefaction preventing device between the second connection pipeline and the low pressure gas refrigerant connection pipeline for preventing liquefaction of high pressure gas refrigerant staying in the second connection pipeline in the mode for cooling all rooms.

Referring to FIG. 1, the liquefaction preventing device includes a supplementary pipeline 27*a* connected between the second connection pipeline and the low pressure gas refrigerant connection pipeline, and an electronic expansion valve 27*b* on the supplementary pipeline for adjusting opening to convert the refrigerant staying in the second connection pipeline 4 into low pressure gas refrigerant.

The plurality of distributors further includes refrigerant introduction shutoff devices 80 each for shutting off introduction of the refrigerant to the distributor connected to the indoor unit operation of which is not required.

It is preferable that the refrigerant introduction shutoff device is an inexpensive ON/OFF valve.

The plurality of distributors B1 and B2 respectively include supercooling devices 13 for sustaining a supercooled state of the high pressure liquid refrigerant in the high pressure liquid refrigerant connection pipeline 21. This is because it is liable that the substantially long distance between the outdoor unit 'A' and the plurality of distributors 'B' and the indoor units 'C' causes a pressure drop of the refrigerant in a process the refrigerant, condensed at the outdoor heat exchanger 2 or the indoor heat exchangers 62, flows in a refrigerant pipeline enough to expand into an unsteady state, which is introduced into the electronic expansion valve 61 in the indoor unit or the heat electronic expansion valve 7*c* in the outdoor unit. Since the unsteady state refrigerant may drop the air conditioning efficiency of the multi-type air conditioner, or irregular noise during operation, the supercooling device is required for prevention of the drop the air conditioning efficiency and occurrence of irregular noise.

A reference symbol 21 represents 21*a*, and 21*b*, 22 represents 22*a*, 22*b*, 22*c*, 22*d*, 22*e*, and 22*f*, 23 represents 23*a*, and 23*b*, 24 represents 24*a*, 24*b*, and 24*c*, 24*d*, 24*e*, and 24*f*, 25 represents 25*a*, and 25*b*, 26 represents 26*a*, 26*b*, and 26*c*, 26*d*, 26*e*, and 26*f*, 27 represents 27*a*, 27*b*, and 27*c*, 31 represents 31*a*, 31*b*, 31*c*, 31*d*, 31*e*, and 31*f*, and 32 represents 32*a*, 32*b*, 32*c*, 32*d*, 32*e*, and 32*f*.

The operation mode of the multi-type air conditioner includes a first mode for cooling all rooms, a second mode for cooling a major number of rooms and heating a minor number of rooms, a third mode for heating all rooms, and a fourth mode for heating a major number of rooms and cooling a minor number of rooms.

It is preferable that the outdoor unit 'A' further includes an outdoor fan (not shown) at an outdoor heat exchanger side. It is preferable that the indoor unit 'C' further includes an indoor fan (not shown) at a side of the indoor heat exchanger.

The multi-type air conditioner with a supercooling device in accordance with other preferred embodiment of the present invention will be described, with reference to FIGS. 2 and 8. Description of a system identical to the basic system of the multi-type air conditioner will be omitted.

Since a system except the supercooling device in the distributor of the multi-type air conditioner in accordance other preferred embodiment of the present invention is identical to the basic embodiment of the present invention, description of the supercooling device will be given.

In the other preferred embodiment of the present invention, the refrigerant flow controlling part is a four way valve 60 for selectively guiding the refrigerant from the compressor to the outdoor heat exchanger 2 or to the distributor depending on an operation condition.

The supercoolining device in the distributor of a multi-type air conditioner in accordance with other preferred embodiment of the present invention has the following system.

Figure 2:
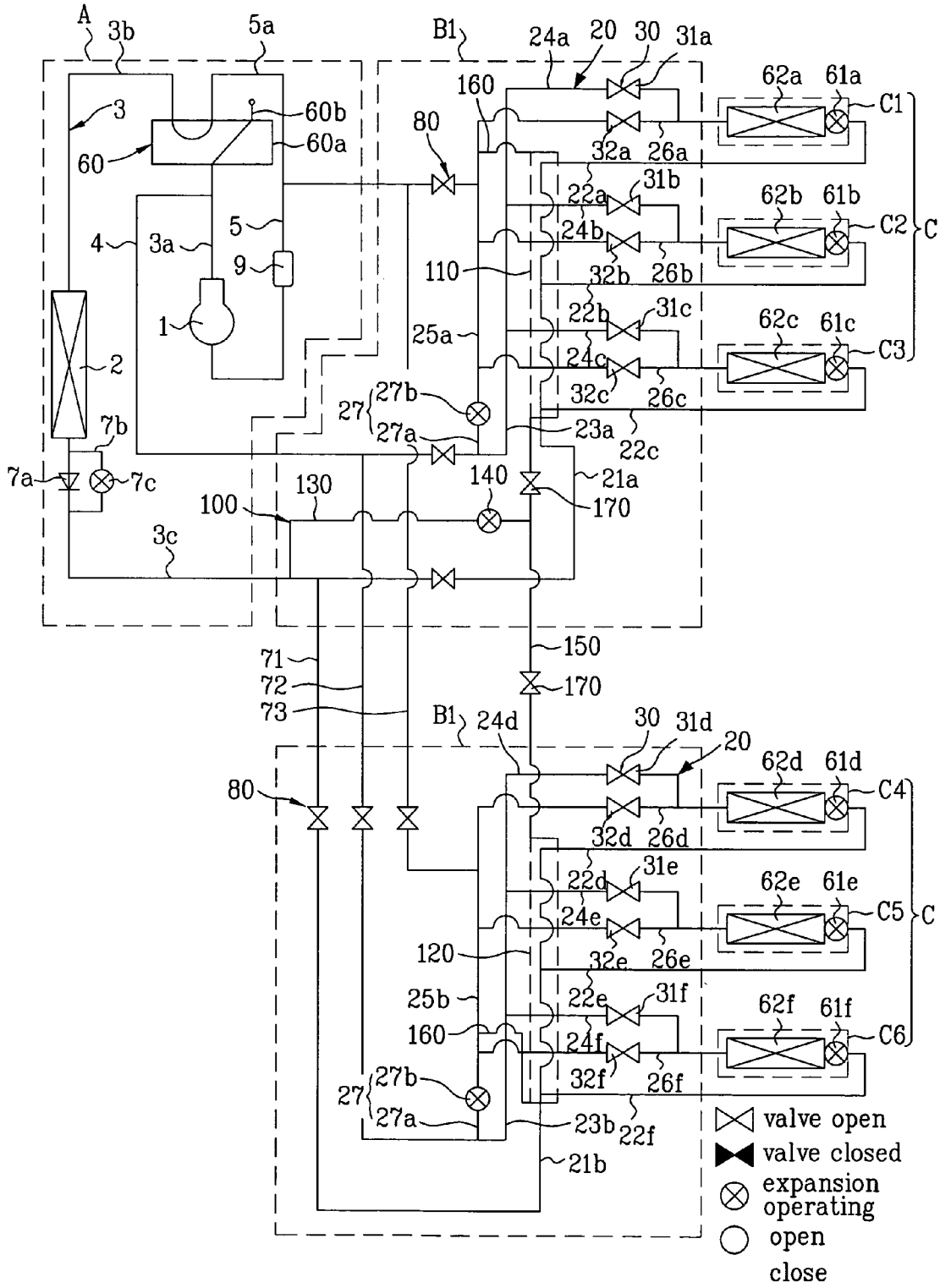
FIG. 2 illustrates a diagram showing a multi-type air conditioner with a plurality of distributors introduction of refrigerant thereto can be shutoff, each with a device for supercooling the refrigerant in accordance with other preferred embodiment of the present invention.

Referring to FIG. 2, the supercooling device includes a leading pipeline 130 branched from a fore end of a pipeline in one of the plurality of distributors the high pressure liquid refrigerant flows therethrough, an expansion means 140 on the leading pipeline for expanding the high pressure liquid refrigerant into low pressure gas refrigerant, first leading branch pipelines 150 having one ends respectively branched from the leading pipeline as many as a number of the plurality of distributors, a heat exchanger part 110 in each of the distributor having one end connected to the other end of the first leading pipeline for supercooling refrigerant in the high pressure liquid refrigerant connection pipeline, and a second leading branch pipeline 160 for guiding low pressure gas refrigerant passed through the heat exchanger in each of the distributors to the low pressure gas refrigerant connection pipeline in the distributor.

In the present invention, though the leading pipeline may be branched from the first connection pipeline 3*c* between the outdoor heat exchanger 2 and the distributor 'B', the leading pipeline is branched from a fore end of the high pressure liquid refrigerant connection pipeline 21 in the distributor taking a length of the pipeline and convenience of installation into account.

Moreover, the supercooling device may further include a refrigerant shutoff part 170 on each of the first leading branch pipelines for shutting off refrigerant introduction into the heat exchanger part 110 to stop heat exchange if the refrigerant is introduced into some of the plurality of distributors.

It is preferable that the refrigerant shutoff part 170 is an ON/OFF valve for open/close depending on an operation condition.

It is preferable that the heat exchanger part 110 is in contact with the pipelines in which the high pressure liquid refrigerant flows, for effective heat exchange. In more detail, it is preferable that a contact area between the heat exchanger part and the high pressure liquid refrigerant connection pipelines large.

Figure 7:
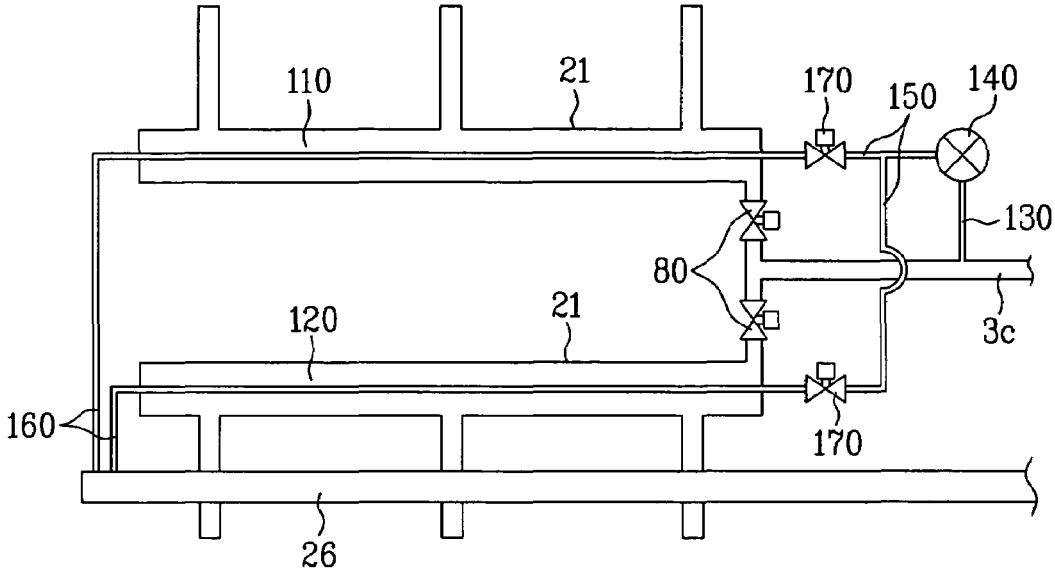
FIG. 7 illustrates a diagram showing a supercooling device in a multi-type air conditioner in accordance with other preferred embodiment of the present invention.

In mounting the heat exchanger part, different methods may be employed. As an example, referring to FIG. 7, the heat exchanger part may be a tubular pipeline passed through an inside of the high pressure liquid refrigerant connection pipeline.

The expansion means 140 may be a capillary tube or the like, in the present invention, the expansion means 140 is an electronic expansion valve.

The principle of the supercooling device will be described.

Figure 8:
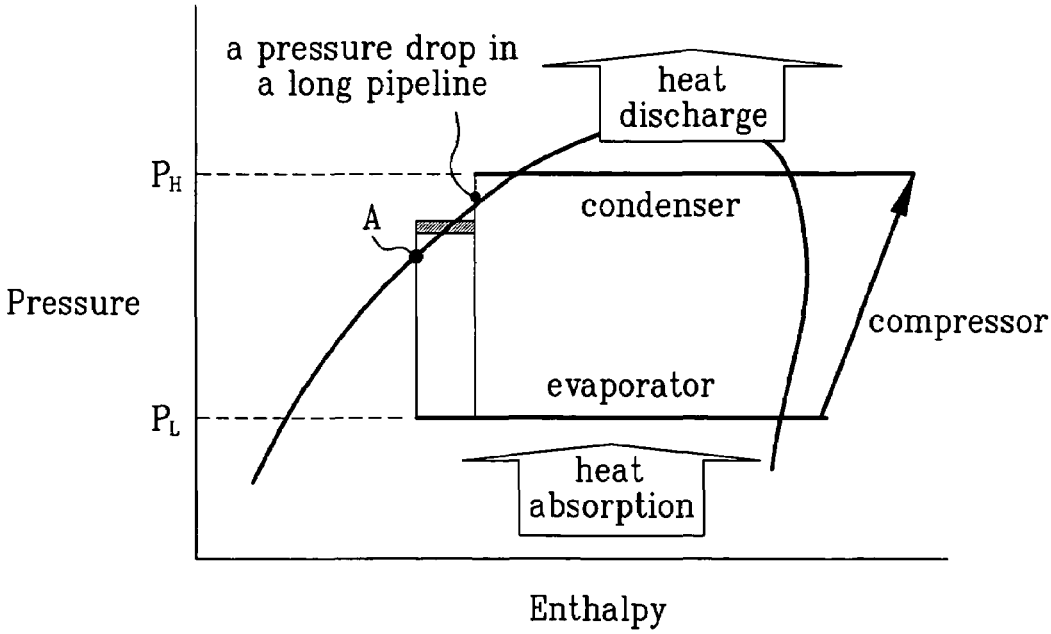
FIG. 8 illustrates a P-h diagram showing a supercooling principle of a supercooling device in a multi-type air conditioner in accordance with other preferred embodiment of the present invention.

As shown in a P-h diagram in FIG. 8, when the heat exchanger part of the supercooling device and the high pressure liquid refrigerant in an unsteady state due to pressure drop heat exchanges, the high pressure liquid refrigerant is involved in enthalpy drop under an isobaric condition to become a supercooled state. The 'A' point is an inlet of the electronic expansion valve.

Refrigerant flow in the multi-type air conditioner in accordance with a other preferred embodiment of the present invention will be described with reference to FIGS. 3~6. However, in explaining the refrigerant flow, it is assumed that since the indoor units C4, C5, and C6 do not require cooling or heating, the refrigerant flow to the distributors and the supercooling devices connected to the indoor units are shutoff.

Figure 3:
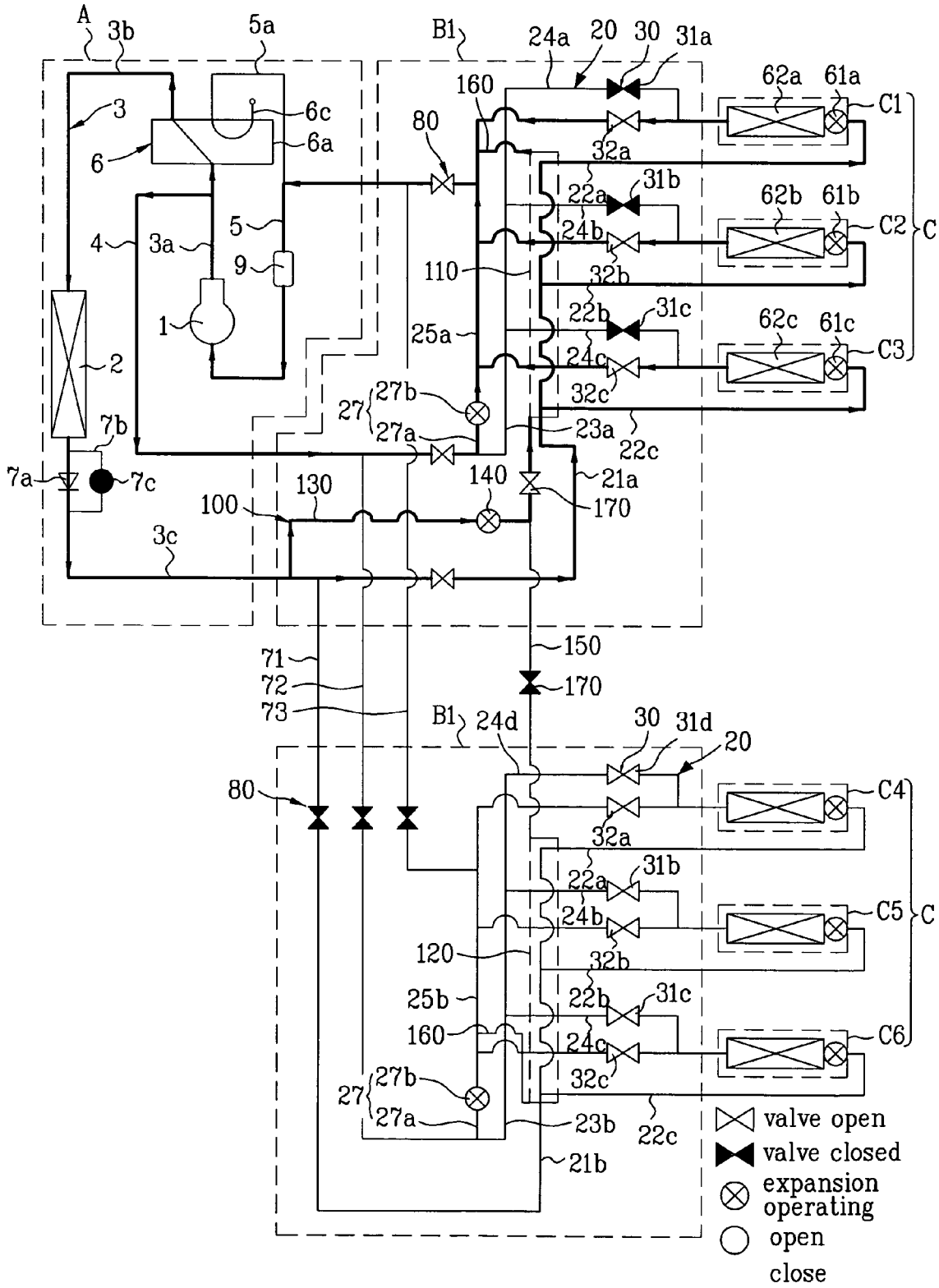
FIG. 3 illustrates a diagram showing a first mode operation of a multi-type air conditioner in accordance with other preferred embodiment of the present invention.

First, referring to FIG. 3, the refrigerant flow of the multi-type air conditioner in accordance with the foregoing embodiment of the present invention in the first mode will be described.

Most of the high pressure refrigerant discharged from the compressor 1 is introduced into the four way valve 60 through the first connection pipeline 3*a*. Then, the refrigerant is guided to, and discharges heat at the outdoor heat exchanger to external air, and introduced into the high pressure liquid refrigerant connection pipeline 21 in the distributor through the check valve 7*a*.

Next, after supercooled at the heat exchanger part 110 in the supercooling device, the refrigerant passed through the high pressure liquid refrigerant connection pipeline 21*a* is guided to the high pressure liquid refrigerant branch pipelines 22 branched as many as the number of indoor units, and introduced into the electronic expansion valves 61 in the indoor units. The high pressure liquid refrigerant introduced into the electronic expansion valve 61 expands at the electronic expansion valve 61, and absorbs heat as the refrigerant passes through the indoor heat exchanger 62.

Figure 4:
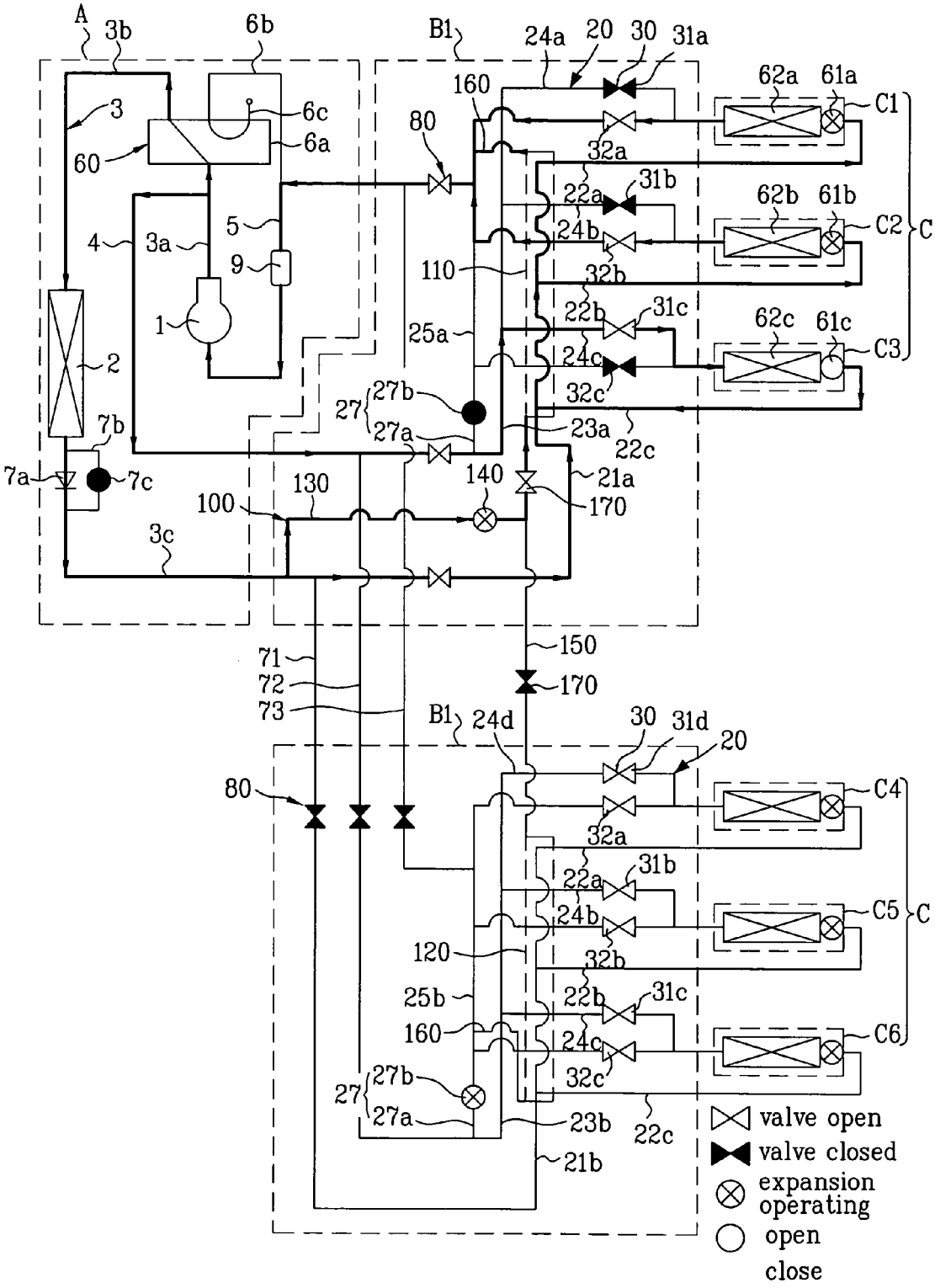
FIG. 4 illustrates a diagram showing a second mode operation of a multi-type air conditioner in accordance with other preferred embodiment of the present invention.

The refrigerant passed through the indoor heat exchanger 62, low pressure refrigerant, flows through the low pressure gas refrigerant pipeline 26 in the distributor. Because, as shown in FIG. 4, the selection valve 31 on the high pressure gas refrigerant branch pipeline 24 is closed, and the selection valve 32 on the low pressure gas refrigerant branch pipeline 26 is opened. The selection valves are electronically controlled proper to operation modes.

The refrigerant passed through the low pressure gas refrigerant branch pipelines 26 comes together to the low pressure gas refrigerant connection pipeline 25, is guided to the third connection pipeline 6 in the indoor unit, and drawn into the compressor 1. The unexplained reference symbol 9 in FIG. 3 denotes an accumulator.

In the meantime, a portion of the high pressure gas refrigerant from the compressor 1 is introduced into the second connection pipeline 5 connected to the first connection pipeline 3*a*. However, since the selection valve 31 on the high pressure gas refrigerant branch pipeline 24 is closed, the high pressure gas refrigerant can not flow further, but stays. However, the staying refrigerant bypasses through the bypass pipeline 27*a* of the liquefaction preventing device 27 between the second connection pipeline 5 and the low pressure gas refrigerant connection pipeline 25, and passes through, and converted into gas refrigerant at the electronic expansion valve 27*b*.

The electronic expansion valve 27*b* on the bypass pipe 27*a* controls an opening thereof for converting the high pressure gas refrigerant staying in the second connection pipeline 5 into a low pressure gas refrigerant, and drawn into the compressor 1 again via the low pressure refrigerant connection pipeline 25.

Refrigerant flow after introduced into the low pressure gas refrigerant connection pipeline 25*a* is the same as described before.

The operation of the supercooling device will be described.

A portion of the refrigerant in the high pressure liquid refrigerant connection pipeline 21 is guided to the leading pipeline 130. The refrigerant in the leading pipeline is expanded at the expansion valve 140, and introduced into the heat exchanger part 110 via the first leading branch pipeline 150. The refrigerant introduced into the heat exchanger part heat exchanges with the refrigerant flowing in the high pressure liquid refrigerant connection pipeline 21*a*, to supercool the refrigerant in the high pressure liquid refrigerant connection pipeline 21*a*, and introduced into the second leading branch pipeline 160. The refrigerant passed through the second leading branch pipeline is drawn into the compressor finally via the low pressure gas refrigerant connection pipeline 26.

Second, referring to FIG. 4, refrigerant flow in the second mode of the multi-type air conditioner in accordance with a preferred embodiment of the present invention will be described.

Most of the high pressure gas refrigerant from the compressor 1 is introduced into the four way valve 60 via the first connection pipeline 3*a*. Then, the refrigerant is guided to, and discharges heat to the outdoor air at, the outdoor heat exchanger 2, and introduced into the high pressure liquid refrigerant connection pipeline 21 in the distributor via the check valve 7*a*. The operation thereafter is the same with the first mode, which will be omitted.

In the meantime, a small portion of refrigerant, excluding the high pressure gas refrigerant introduced into the four way valve 60, is guided to the high pressure gas refrigerant connection pipeline 23 in the distributor through the second connection pipeline 4. Different from the first mode, in the second mode, since the electronic expansion valve 27*b* of the liquefaction preventing device 27 is closed, no refrigerant is introduced into the low pressure gas refrigerant connection pipeline 25.

In the meantime, when the room to be heated is C3, opposite to the room to be cooled, of the selection valves of the distributor connected to C3, the selection valve 31*c* on the high pressure refrigerant branch pipeline is opened, and the selection valve 32*c* on the low pressure refrigerant branch pipeline is closed, such that the refrigerant through the high pressure gas refrigerant connection pipeline 23*a* is guided to the high pressure gas refrigerant branch pipeline 24*c* connected to the room that requires heating.

The refrigerant guided to the high pressure gas refrigerant branch pipeline 24*c* is introduced into, and discharges heat at, the indoor heat exchanger 62*c*, and introduced into the high pressure liquid refrigerant branch pipeline 22*c* connected to the indoor unit.

The refrigerant guided through the high pressure liquid refrigerant branch pipeline 22*c* joins with the refrigerant flowing through the outdoor heat exchanger 3 at the high pressure liquid refrigerant connection pipeline 21*a*. A process thereafter is the same with the first mode.

In the meantime, in this mode, the operation of the supercooling device, the same with the first mode, will be omitted.

Figure 5:
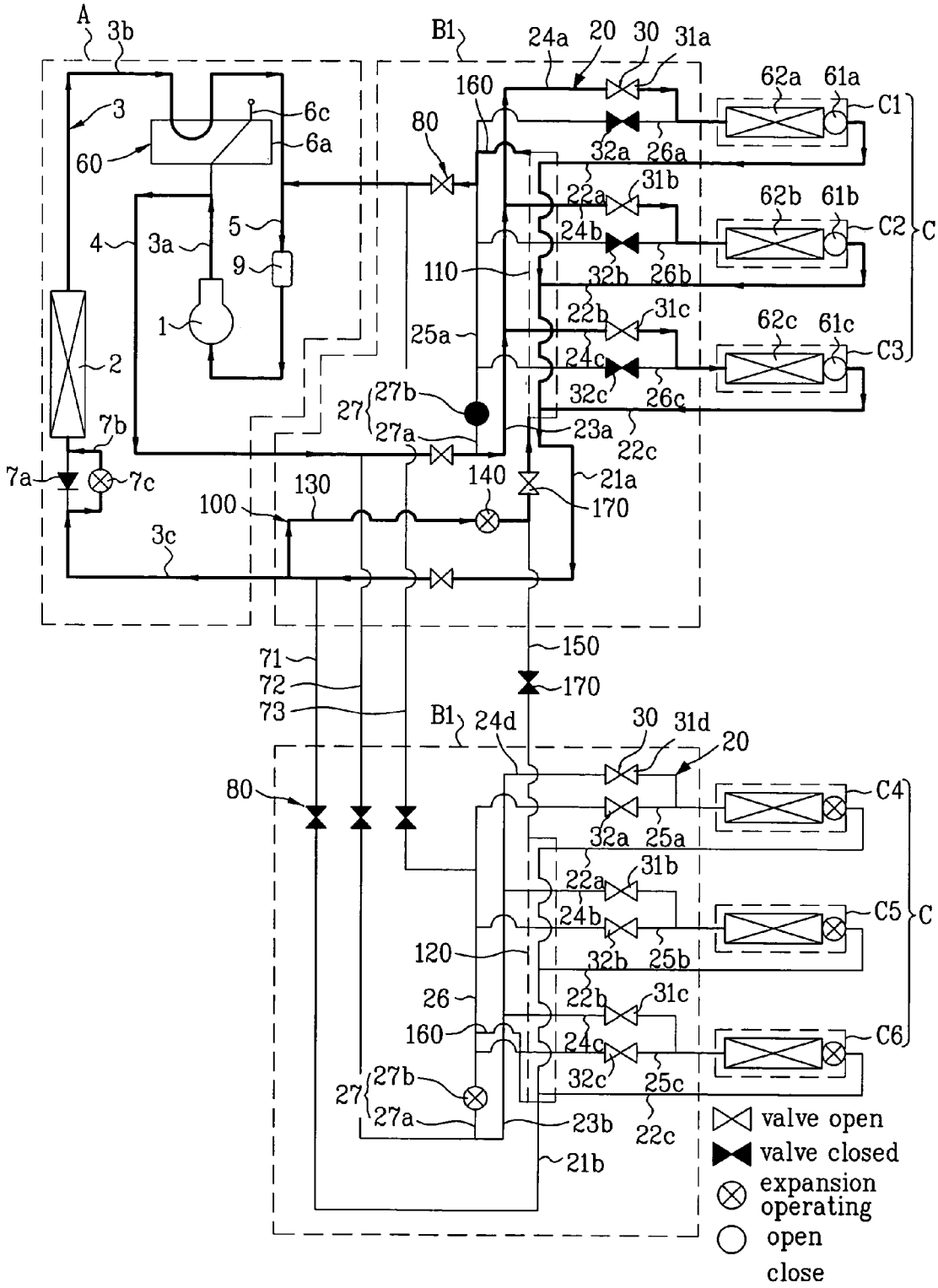
FIG. 5 illustrates a diagram showing a third mode operation of a multi-type air conditioner in accordance with other preferred embodiment of the present invention.

Third, referring to FIG. 5, refrigerant flow in the third mode of the multi-type air conditioner in accordance with a first preferred embodiment of the present invention will be described.

Most of the high pressure gas refrigerant from the compressor 1 is guided to the second connection pipeline 4 via the first connection pipeline 3*a* by the four way valve 60. The introduced refrigerant is guided to the high pressure gas refrigerant connection pipeline 23 in the distributor, directly. The refrigerant guided to the high pressure gas refrigerant connection pipeline 23*a* is introduced into to the high pressure refrigerant branch pipelines 24 to respective indoor units.

In the third mode, opposite to the first mode, of the electronically controlled selection valves in the distributor, the selection valves 31 on the high pressure gas refrigerant branch pipelines 24 are opened, and the selection valves 32 on the low pressure gas refrigerant branch pipelines 26 are closed, so that the refrigerant flows through the high pressure gas refrigerant branch pipelines 24, and is introduced into, and discharges heat at, the indoor heat exchangers 62.

The high pressure liquid refrigerant from the indoor heat exchangers passes through the fully opened electronic expansion valves 61, is guided to the high pressure liquid refrigerant branch pipelines 22 and the high pressure refrigerant connection pipeline 21, and flows through the first connection pipeline 3*c* of the outdoor unit.

The refrigerant guided through the first connection pipeline 3*c* passes the electronic expansion valve 7*c* on the parallel pipe 7*b* mounted parallel to the check valve 7*a*, and introduced into the outdoor heat exchanger 2. This is because, in the third mode, the check valve 11 is closed.

The refrigerant introduced into, and absorbs heat at, the outdoor heat exchanger 2, and is introduced into the four way valve 60 via the first connection pipeline 3*b*. The refrigerant introduced into the four way valve 60 is drawn into the compressor 1 via a branch pipeline 5*a* from the third connection pipeline and the third connection pipeline.

Next, the operation of the supercooling device in this mode will be described.

A portion of the refrigerant flowing in the high pressure liquid refrigerant connection pipeline 21 is guided to the leading pipeline 130. The refrigerant flowing through the leading pipeline is expanded at the expansion valve, and introduced into the heat exchanger part 110 via the first leading branch pipeline 150. The refrigerant introduced into the heat exchanger part heat exchanges with the refrigerant flowing in the high pressure liquid connection pipeline 21*a*, to supercool the refrigerant in the high pressure liquid refrigerant connection pipeline, and introduced into the second leading branch pipeline 160. The refrigerant passed through the second leading branch pipeline is drawn into the compressor 1 finally through the low pressure gas refrigerant connection pipeline 25*a*.

Figure 6:
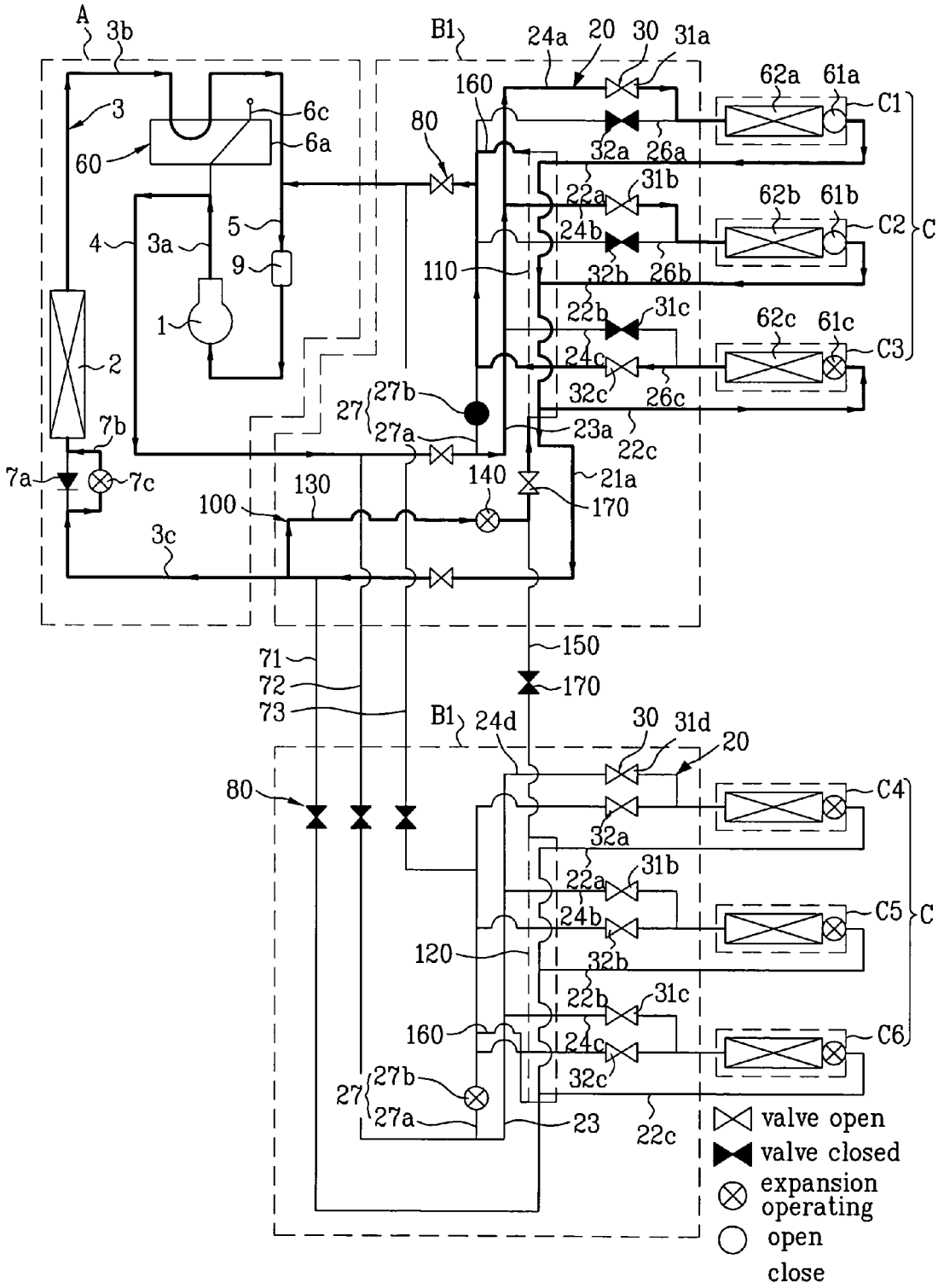
FIG. 6 illustrates a diagram showing a fourth mode operation of a multi-type air conditioner in accordance with other preferred embodiment of the present invention.

Fourth, referring to FIG. 6, the refrigerant flow in the fourth mode in the multi-type air conditioner in accordance with a preferred embodiment of the present invention will be described.

Most of the high pressure gas refrigerant from the compressor 1 is introduced into the distributor through the second connection pipeline 4. If the rooms that require heating are C1 and C2, and a room that requires cooling is C3, the introduced refrigerant passes through the high pressure gas refrigerant connection pipeline 23, and introduced into, and discharges heat at, the indoor heat exchangers 62*a*, and 62*b* in the indoor units in the rooms C2 and C3 that require heating through the high pressure refrigerant branch pipelines 24 under the control of the selection valves in the distributor. Then, the refrigerant passes through the fully opened electronic expansion valves 61*a* and 61*b*, and flows through the high pressure liquid refrigerant branch pipelines 22*a* and 22*b* and the high pressure liquid refrigerant connection pipeline 21*a*.

In the meantime, opposite to the rooms that require heating, of the selection valves in the distributor connected to the room C3 that requires cooling, the selection valve 31*c* on the high pressure gas refrigerant branch pipeline 24*c* is closed, and the selection valve 32*c* on the low pressure gas refrigerant branch pipeline 26*c* is opened, such that a portion of high pressure liquid refrigerant in the refrigerant flowing through the high pressure liquid refrigerant connection pipeline 21 is guided to the high pressure liquid refrigerant branch pipeline 22*c* connected to the room C3 that requires cooling. Flow of the rest of the refrigerant excluding the portion of high pressure liquid refrigerant guided to the high pressure liquid refrigerant branch pipeline 22*c* is identical to the case of the third mode, of which description will be omitted.

The refrigerant guided to the high pressure liquid refrigerant branch pipeline 22*c* is expanded at the electronic expansion valve 61*c* in the indoor unit in the room that requires cooling, introduced into, and absorbs heat at, the indoor heat exchanger 62*c*, and flows to the opened low pressure liquid refrigerant branch pipeline 26*c*.

The low pressure gas refrigerant flowing through the low pressure gas refrigerant branch pipeline 26*c* passes through the low pressure gas refrigerant connection pipeline 25, joins with the refrigerant flowing through the outdoor heat exchanger 2 at the third connection pipeline 5, and drawn into the compressor 1.

In the meantime, in this mode, the operation of the supercooling device is the same with the defrosting device in the third mode, of which description will be omitted.

As has been described, the multi-type air conditioner of the present invention has the following advantages.

First, the multi-type air conditioner of the present invention can deal with individual room condition in an optimal condition. All the operation modes of first mode for cooling all rooms, a second mode for cooling a major number of rooms and heating a minor number of rooms, a third mode for heating all rooms, and a fourth mode for heating a major number of rooms and cooling a minor number of rooms, are possible.

Second, even if the room is large and a room structure is complex, the air conditioning efficiency can be improved, because installation freedom of the plurality of indoor unit are improved and the refrigerant introduction into the distributors connected to inoperative indoor units are shutoff in advance.

Third, the introduction of supercooled high pressure liquid refrigerant into the expansion valve and the heat exchanger prevents occurrence of irregular noise and improved the air conditioning efficiency.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A multi-type air conditioner comprising:

an outdoor unit installed outdoors and including a compressor, a refrigerant flow controlling part connected to a discharge end of the compressor and configured to guide the refrigerant proper to operation conditions selectively, and an outdoor heat exchanger connected to the refrigerant flow controlling part;

a plurality of indoor units each installed in a room and having an indoor heat exchanger and an electronic expansion valve having one end connected to one end of the indoor heat exchanger;

at least two distributors between the outdoor unit and the plurality of indoor units for improving installation freedom of the plurality of indoor units, and configured to selectively guide refrigerant from the outdoor unit to the plurality of indoor units proper to operation conditions, and to guide the refrigerant passed through the indoor units to the outdoor unit again, each of the distributors further configured to distribute the refrigerant to at least two of the plurality of indoor units; and a shut-off device configured to selectively shut off introduction of the refrigerant into each distributor, wherein the shut-off device shuts off the refrigerant into the each distributor when all of the indoor units connected to each distributor are inoperative.

2. The multi-type air conditioner as claimed in claim 1, wherein the shut-off device is an ON/OFF valve.

3. The multi-type air conditioner as claimed in claim 1, wherein the plurality of distributors include supercooling devices respectively disposed on pipelines through which high pressure liquid refrigerant flows therein and configured to supercool the high pressure liquid refrigerant.

4. The multi-type air conditioner as claimed in claim 3, wherein the supercooling device includes:

a leading pipeline branched from a fore end of a pipeline in one of the plurality of distributors through which the high pressure liquid refrigerant flows;

an expander on the leading pipeline and configured to expand the high pressure liquid refrigerant into low pressure gas refrigerant;

first leading branch pipelines each having one end respectively branched from the leading pipeline, the quantity of first leading branch pipelines being as many as the quantity of the plurality of distributors;

a heat exchanger part in each of the distributors and having one end connected to the other end of the first leading pipeline, the heat exchanger configured to sustain a supercooled state of refrigerant in the high pressure liquid refrigerant connection pipeline; and a second leading branch pipeline configured to guide low pressure gas refrigerant passed through the heat exchanger in each of the distributors to the low pressure gas refrigerant connection pipeline to be introduced into the compressor.

5. The multi-type air conditioner as claimed in claim 4, wherein the supercooling device further includes a refrigerant shutoff part on each of the first leading branch pipelines.

6. The multi-type air conditioner as claimed in claim 5, wherein the refrigerant shutoff part is an ON/OFF valve configured to open and/or close proper to operation conditions.

7. The multi-type air conditioner as claimed in claim 4, wherein the heat exchanger part is in contact with pipelines through which the high pressure liquid refrigerant flows therein.

8. The multi-type air conditioner as claimed in claim 7, wherein the heat exchanger part includes a pipeline passed through an inside of the pipeline through which the high pressure liquid refrigerant flows therein.

9. The multi-type air conditioner as claimed in claim 4, wherein the expander is an electronic expansion valve.

10. The multi-type air conditioner as claimed in claim 1, wherein the outdoor unit further includes:

a first connection pipeline having one end connected to a discharge end of the compressor and the other end connected to the distributor with the refrigerant flow controlling part and the outdoor heat exchanger connected in succession between the two ends;

a second connection pipeline connected to the first connection pipeline connected between the refrigerant flow controlling part and the discharge end of the compressor, and configured to guide compressed refrigerant to the distributors directly; and a third connection pipeline connected between the suction end of the compressor and the distributors, and having a branch pipeline connected to one end of the refrigerant flow controlling part, the third connection pipeline configured to guide low pressure gas refrigerant to the compressor.

11. The multi-type air conditioner as claimed in claim 10, wherein the distributor includes:

a guide piping system configured to guide the refrigerant introduced thereto through the first connection pipeline or the second connection pipeline in the outdoor unit to the indoor units, and the refrigerant from the indoor units to the first connection pipeline or to the third connection pipeline in the outdoor unit proper to operation conditions; and a valve bank on the guide piping system and configured to control refrigerant flow such that the refrigerant flows in/out of the indoor units, selectively proper to operation conditions.

12. The multi-type air conditioner as claimed in claim 11, wherein the guide piping system includes:

a high pressure liquid refrigerant connection pipeline having one end connected to the first connection pipeline in the outdoor unit, high pressure liquid refrigerant branch pipelines each having one end branched from the high pressure liquid refrigerant connection pipeline, the quantity of one ends being as many as the quantity of the indoor units, and the other end of each of the high pressure liquid refrigerant branch pipelines connected to one of the other ends of the indoor electronic expansion valves, respectively;

a high pressure gas refrigerant connection pipeline having one end connected to the second connection pipeline in the outdoor unit directly;

high pressure gas refrigerant branch pipelines each having one end branched from the high pressure gas refrigerant connection pipeline, the quantity of one ends being as many as the quantity of the indoor units, and the other end of each of the high pressure gas refrigerant branch pipelines directly connected to one of the other ends of the indoor heat exchangers of respective indoor units, respectively;

a low pressure gas refrigerant connection pipeline having one end connected to the third connection pipeline in the outdoor unit directly; and low pressure gas refrigerant branch pipelines each having one end branched from the low pressure gas refrigerant connection pipeline, the quantity of low pressure gas refrigerant branch pipelines being as many as the quantity of indoor units, and the other end of each of the low pressure gas refrigerant branch pipelines connected to one of the other ends of the indoor heat exchangers of the respective indoor units to which the high pressure gas refrigerant branch pipelines are connected, respectively.

13. The multi-type air conditioner as claimed in claim 12, wherein the valve bank includes:

selection valves on the high pressure gas refrigerant branch pipelines and the low pressure gas refrigerant branch pipelines, the selection valves configured to close the valves on the high pressure gas refrigerant branch pipelines and to open the valves on the low pressure gas refrigerant branch pipelines in a case of room cooling, and further configured to open and/or close the valves in an opposite manner in a case of room heating, for controlling refrigerant flow.

14. A multi-type air conditioner comprising:

an outdoor unit installed outdoors and including a compressor, a four way valve connected to a discharge end of the compressor and configured to guide the refrigerant proper to operation conditions selectively, and an outdoor heat exchanger connected to the four way valve;

a plurality of indoor units each installed in a room and having an indoor heat exchanger and an electronic expansion valve having one end connected to one end of the indoor heat exchanger;

a plurality of distributors between the outdoor unit and the plurality of indoor units for improving installation freedom of the plurality of indoor units, and configured to selectively guide refrigerant from the outdoor unit to the plurality of indoor units proper to operation conditions, and to guide the refrigerant passed through the indoor units to the outdoor unit again, each of the distributors distributing the refrigerant to at least two of the plurality of indoor units and having a supercooling device on a pipeline through which the high pressure liquid refrigerant flows therein, the supercooling device configured to sustain a supercooled state of the high pressure liquid refrigerant; and an ON/OFF valve configured to selectively shut off introduction of the refrigerant into each distributor, wherein the ON/OFF valve shuts off the refrigerant into the each distributor when all of the indoor units connected to each distributor are inoperative.

15. The multi-type air conditioner as claimed in claim 14, wherein the supercooling device includes a leading pipeline branched from a fore end of a pipeline in one of the plurality of distributors through which the high pressure liquid refrigerant flows;

an expander on the leading pipeline and configured to expand the high pressure liquid refrigerant into low pressure gas refrigerant;

first leading branch pipelines each having one end respectively branched from the leading pipeline, the quantity of first leading branch pipelines being as many as the quantity of the plurality of distributors;

a heat exchanger part in each of the distributors, each heat exchanger having one end thereof connected to the other end of the first leading pipeline and configured to sustain a supercooled state of refrigerant in the high pressure liquid refrigerant connection pipeline; and a second leading branch pipeline configured to guide low pressure gas refrigerant passed through the heat exchanger in each of the distributors to the low pressure gas refrigerant connection pipeline to be introduced into the compressor.

16. The multi-type air conditioner as claimed in claim 15, wherein the supercooling device further includes an ON/OFF valve on the first leading branch pipeline, the ON/OFF valve configured to shut off the refrigerant.

17. The multi-type air conditioner as claimed in claim 16, wherein the heat exchanger part is a tubular pipeline passed through an axis direction of an inside of the pipeline through which the high pressure liquid refrigerant flows therein.

* * * * *